US009706840B2

(12) United States Patent
Tsuchiyama et al.

(10) Patent No.: US 9,706,840 B2
(45) Date of Patent: Jul. 18, 2017

(54) DESK APPARATUS

(71) Applicant: OKAMURA CORPORATION, Kanagawa (JP)

(72) Inventors: Waku Tsuchiyama, Yokohama (JP); Masayuki Kuroe, Yokohama (JP); Haruyuki Kagaya, Yokohama (JP)

(73) Assignee: OKAMUR CORPORATION, Kanagawa (JP)

( * ) Notice: Subject to any disclaimer, the term of this patent is extended or adjusted under 35 U.S.C. 154(b) by 0 days.

(21) Appl. No.: 14/780,476

(22) PCT Filed: Oct. 29, 2013

(86) PCT No.: PCT/JP2013/079268
§ 371 (c)(1),
(2) Date: Sep. 25, 2015

(87) PCT Pub. No.: WO2015/063862
PCT Pub. Date: May 7, 2015

(65) Prior Publication Data

US 2016/0255957 A1 Sep. 8, 2016

(51) Int. Cl.
*A47B 21/00* (2006.01)
*A47B 91/08* (2006.01)
(Continued)

(52) U.S. Cl.
CPC ..... *A47B 91/08* (2013.01); *A47B 13/02* (2013.01); *A47B 21/00* (2013.01); *A47B 13/06* (2013.01);
(Continued)

(58) Field of Classification Search
CPC ..... A47B 21/00; A47B 21/06; A47B 83/001
(Continued)

(56) References Cited

U.S. PATENT DOCUMENTS 6,283,043 B1 * 9/2001 Stern ..... A47B 13/06 108/50.02
2003/0070595 A1 * 4/2003 Crinion ..... A47B 17/00 108/65
(Continued)

FOREIGN PATENT DOCUMENTS

CA 2359737 * 4/2003
CH 705498 * 3/2013
(Continued)

OTHER PUBLICATIONS

International Search Report for PCT Application No. PCT/JP2013/079268 mailing date Jan. 28, 2014.
(Continued)

*Primary Examiner* — Janet M Wilkens
(74) *Attorney, Agent, or Firm* — Nixon Peabody LLP; Khaled Shami

(57) ABSTRACT

A desk apparatus is provided with a pair of leg members, each having two main leg member parts that are installed on a floor surface and extend in a vertical direction and that are connected to each other by means of a crosspiece portion at upper portions of the main leg member parts, and a pair of inner connecting rods and a pair of outer connecting rods that extend along a width direction and connect the upper portions of the pair of leg members. The inner connecting rods are connected together by bridge members so as to constitute connecting units. The connecting units are attachable to and detachable from a top plate support, and a first top plate unit is attachable to and detachable from the top plate support. This allows for the provision of a desk apparatus in which the first top plate unit and the connecting units are replaceable with different top plate units and different connecting units, and the aspects of the desk apparatus can be changed in accordance with a user's
(Continued)

demands by keeping replacement of members to a necessary minimum.

9 Claims, 5 Drawing Sheets

(51) Int. Cl.
*A47B 13/02* (2006.01)
*A47B 13/06* (2006.01)

(52) U.S. Cl.
CPC ..... *A47B 2200/0012* (2013.01); *A47B 2200/0014* (2013.01)

(58) Field of Classification Search
USPC ..... 312/194–196, 223.3, 223.6; 108/50.01, 108/50.02, 25, 155, 157.1
See application file for complete search history.

(56) References Cited

U.S. PATENT DOCUMENTS

2005/0284341 A1* 12/2005 Klassy ..... A47B 21/00 108/50.02
2008/0295745 A1* 12/2008 Hamilton ..... A47B 13/06 108/50.02
2009/0165680 A1* 7/2009 Bakker ..... A47B 21/06 108/50.02
2009/0273260 A1* 11/2009 Kemp ..... A47B 21/06 312/223.3
2011/0297051 A1* 12/2011 Martin ..... A47B 3/06 108/25
2014/0062145 A1* 3/2014 Iacovoni ..... A47B 83/02 297/135
2015/0250301 A1* 9/2015 Tsuchiyama ..... A47B 13/02 108/42

FOREIGN PATENT DOCUMENTS

| | | | | |
|---|---|---|---|---|
| CN | 101820796 | A | | 9/2010 |
| CN | 202681053 | U | | 1/2013 |
| EP | 898909 | | * | 3/1999 |
| JP | 3440842 | B | | 8/2003 |
| JP | 2006-020921 | A | | 1/2006 |
| JP | 2007130320 | A | | 5/2007 |
| JP | 2008-119412 | A | | 5/2008 |
| JP | 2008-119413 | A | | 5/2008 |
| JP | 4133239 | B | | 8/2008 |
| JP | 2008-295853 | A | | 12/2008 |
| JP | 4204819 | B | | 1/2009 |
| JP | 2009-142572 | A | | 7/2009 |
| JP | 2009-148496 | A | | 7/2009 |
| JP | 2013-094276 | A | | 5/2013 |
| WO | 2004021830 | | * | 3/2004 |

OTHER PUBLICATIONS

Office Action with partial translation dated Jan. 20, 2017 of the Chinese Patent Application No. 201380075038.9.

* cited by examiner

DESK APPARATUS

CROSS-REFERENCE TO RELATED PATENT APPLICATION

The present application is a National Stage Application of International Application No. PCT/JP2013/079268 entitled "DESK APPARATUS" filed Oct. 29, 2013, the contents of which is incorporated herein by reference in its entirety. This application is further related to Japanese Patent Application Number 2012-218666 filed Sep. 28, 2012.

TECHNICAL FIELD

The present invention relates to a desk apparatus to be used in a work space, such as an office.

BACKGROUND ART

Generally, desk apparatuses in which a top plate is supported by a pair of leg members installed on a floor surface are used in work space, such as an office.

As leg members of these types of desk apparatuses, a type (a so-called L-type leg) that is formed such that a lower pipe extending along a floor surface and placed sideways on the floor surface, a vertical pipe extending upward from one end or a central portion of the lower pipe, and an upper pipe extending parallel to the lower pipe from an upper end of the vertical pipe form a U-shape in a side view, and a type (a so-called T-type leg) that is formed such that these pipes form an H-shape are seen in many cases. Additionally, as the leg members made of materials other than the pipe material, panel-like types are also seen in many cases.

Since floor surface contact portions in the leg members are large in the structure of these desk apparatuses, a top plate unit can be firmly and stably supported by the leg members.

However, there is a possibility that this structure may give a heavy impression to a user and may not be preferable for the appearance of the desk apparatuses. Additionally, since the floor surface contact portions of the leg members are large, the structure of these desk apparatuses is apt to interfere with work when the floor surface is cleaned.

In addition, as a desk apparatus in which these problems do not occur easily, there are many types of the desk apparatus in which rod-shaped leg members are each attached to four corners of a rectangular top plate unit and each lower end of the rod-shaped leg members is installed on a floor surface. However, since the top plate unit is supported only by the rod-shaped leg members, there is a possibility that the structure of this desk apparatus may decrease in terms of the strength against an external force from a lateral side of the desk apparatus.

As a desk apparatus that has solved such a problem, there is suggested a type that is provided with a pair of leg members formed by connecting a pair of rod-shaped main leg member parts to each other by means of crosspiece portions, and a plurality of connecting rods that connect upper portions of the pair of leg members arranged to be separated from each other in the width direction and that is capable of attaching the top plate unit to the crosspiece portions of the leg members and upper surfaces of the connecting rods (for example, refer to Patent Documents 1 and 2).

Additionally, when such a desk apparatus is used in an office or the like, there is demand for lead out wiring lines of electronic apparatuses, such as personal computers and projectors, lighting systems, and telephones, from the upper surface of the top plate unit.

As desk apparatuses that meet such demands, there is a known type in which an opening for leading out wiring lines is formed at the center of a top plate unit in a depth direction and wiring receiving members are attached to leg members or connecting rods so as to cover the lower side of the opening (for example, refer to Patent Documents 3 and 4).

In this desk apparatus, the wiring lines can be led out to arbitrary positions on the top plate unit through the central opening while securing a wide work area on the top plate unit so as to surround the opening.

Additionally, as another type of desk apparatuses that meet the above demands, there is a known type in which upper portions of a pair of leg members are connected together by a plurality of connecting rods to form a top plate support, a pair of top plates are attached to an upper surface of the top plate support so as to be separated from each other by a predetermined dimension backward and forward in a depth direction, and an elongated wiring receiving member that covers a lower side of a separation space extending along a width direction between both of the top plates is attached to the connecting rods or the like (for example, refer to Patent Documents 5 and 6).

In the desk apparatuses, wiring lines can be freely led out from arbitrary front and rear positions in the depth direction through the elongated separation space of the center of the top plate in the depth direction. Therefore, there is an advantage that a user's degree of freedom in wiring becomes high.

CITATION LIST

Patent Document

[Patent Document 1] Japanese Unexamined Patent Application, First Publication No. 2008-119412

[Patent Document 2] Japanese Unexamined Patent Application, First Publication No. 2008-119413

[Patent Document 3] Japanese Patent Publication No. 3440842

[Patent Document 4] Japanese Patent Publication No. 4204819

[Patent Document 5] Japanese Unexamined Patent Application, First Publication No. 2009-142572

[Patent Document 6] Japanese Unexamined Patent Application, First Publication No. 2009-148496

SUMMARY OF INVENTION

Technical Problem

However, the above two types of desk apparatuses are different from each other in terms of the form of the top plates or the wiring lead-out portions, and are purchased and used in consideration of an indoor layout or a user's usage patterns. Therefore, if there are changes in organization in workplaces or changes in the manner of work, replacement with other desk apparatuses should be made, and a purchaser's cost burden becomes large.

Thus, the invention provides a desk apparatus that can change the aspect thereof in accordance with a user's demands by keeping the replacement of members to a minimum.

Solution to Problem

The following configurations are adopted in the desk apparatus related to the invention in order to solve the above problems.

A first aspect related to the invention is a desk apparatus including a pair of leg members each having two main leg member parts that are installed on a floor surface and extend in a vertical direction and that are connected to each other by means of a crosspiece portion at upper portions of the above-described main leg member parts; a plurality of connecting rods that extend along a width direction orthogonal to a depth direction that is a direction in which the crosspiece portion extends and that connect upper portions of the pair of leg members; and a top plate unit that is supported by the pair of leg members. The plurality of connecting rods includes a pair of inner connecting rods arranged to be separated from each other in a central region of the top plate unit in the depth direction. The pair of inner connecting rods are connected together by a plurality of bridge members along the depth direction to constitute a connecting unit. The top plate unit is attachable to and detachable from a top plate support including the pair of leg members, the connecting unit, and remaining connecting rods excluding the inner connecting rods, and part or all of the connecting unit is attachable to and detachable from remaining members of the top plate support and are replaceable with a top plate unit and a connecting unit having different aspects and functions.

A second aspect related to the invention is the desk apparatus based on the first aspect in which a plurality of the connecting units having different aspects of the bridge members may be prepared, and the connecting units may be replaceable when a top plate unit in which an opening is provided at the center of a top plate in the depth direction is adopted, and when a top plate unit in which a separation space that is continuous along the width direction is provided at the center in the depth direction and a plurality of the top plates are arranged to face each other is adopted.

A third aspect related to the invention is the desk apparatus based on the first aspect in which the plurality of bridge members of the connecting unit may be attachable to and detachable from the pair of inner connecting rods, and the connecting positions of the bridge members to the pair of inner connecting rods may be changeable when a top plate unit in which an opening is provided at the center of a top plate in the depth direction is adopted, and when a top plate unit in which a separation space that is continuous along the width direction is provided at the center in the depth direction and a plurality of the top plates are arranged to face each other is adopted.

Accordingly, when the top plate unit is replaced with a top plate unit having a different aspect, it is possible to meet the above demands simply by changing the connecting positions of the bridge members without replacing the pair of inner connecting rods.

A fourth aspect related to the invention is the desk device based on any one of the first to third aspects in which an optional member may be laid over the adjacent bridge members of the connecting unit.

A fifth aspect related to the invention is the desk device based on the fourth aspect in which the optional member may be a wiring cover that opens and closes the opening provided at the center of the top plate unit in the depth direction or the separation space, along the width direction, of the center of the top plate unit in the depth direction.

Advantageous Effects of Invention

According to this invention, the top plate unit is attachable to and detachable from the top plate support including the pair of leg members, the connecting unit, and remaining connecting rods excluding the inner connecting rods, and part or all of the connecting unit is attachable to and detachable from remaining members of the top plate support. Therefore, the aspects of the desk apparatus can be changed in accordance with a user's demands by replacing or changing part or all of the top plate unit and the connecting units.

DESCRIPTION OF EMBODIMENTS

Figure 1:
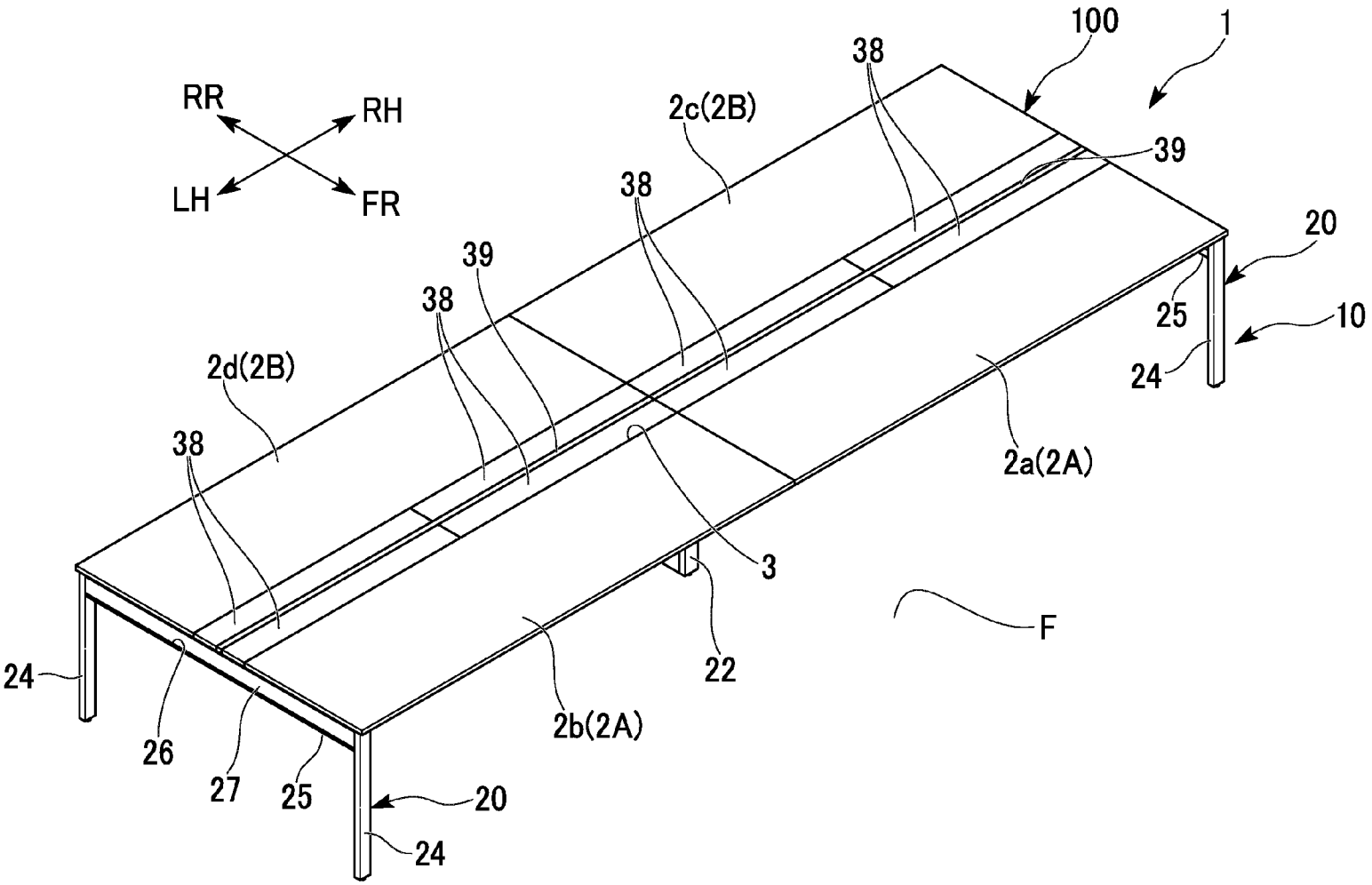
FIG. 1 is a perspective view of a desk apparatus to which a first top plate unit of an embodiment of this invention is attached.

Hereinafter, a desk apparatus of an embodiment of the invention will be described with reference to the drawings. In the desk apparatus related to this embodiment, a plurality of top plate units having different aspects (different shapes and functions) are replaceable.

In addition, in the following description, a direction perpendicular to a floor surface F is referred to as a vertical direction, a longer direction (longitudinal direction) of a top plate unit is referred to as a width direction, and a shorter direction of the top plate unit is referred to as a depth direction. Additionally, an arrow that connects LH and RH in the drawings indicates the width direction, and an arrow that connects FR and RR in the drawings indicates the depth direction. The depth direction is a direction that coincides with a direction in which a crosspiece portion 25 of a leg member 20 to be described below extends, and the width direction is a direction orthogonal to the vertical direction and the depth direction.

Figure 2:
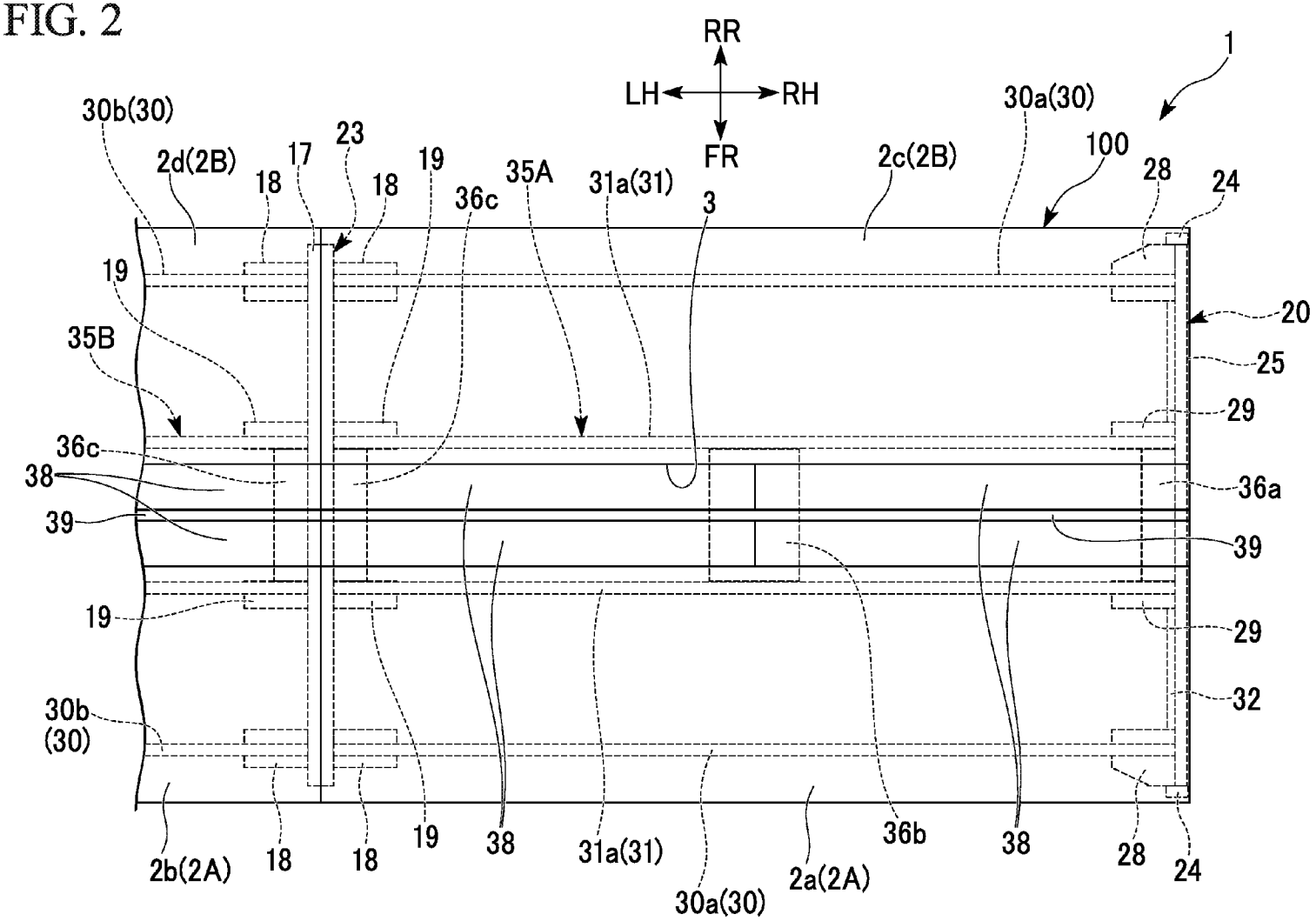
FIG. 2 is a plan view of the desk apparatus to which the first top plate unit of the embodiment of this invention is attached.
Figure 3:
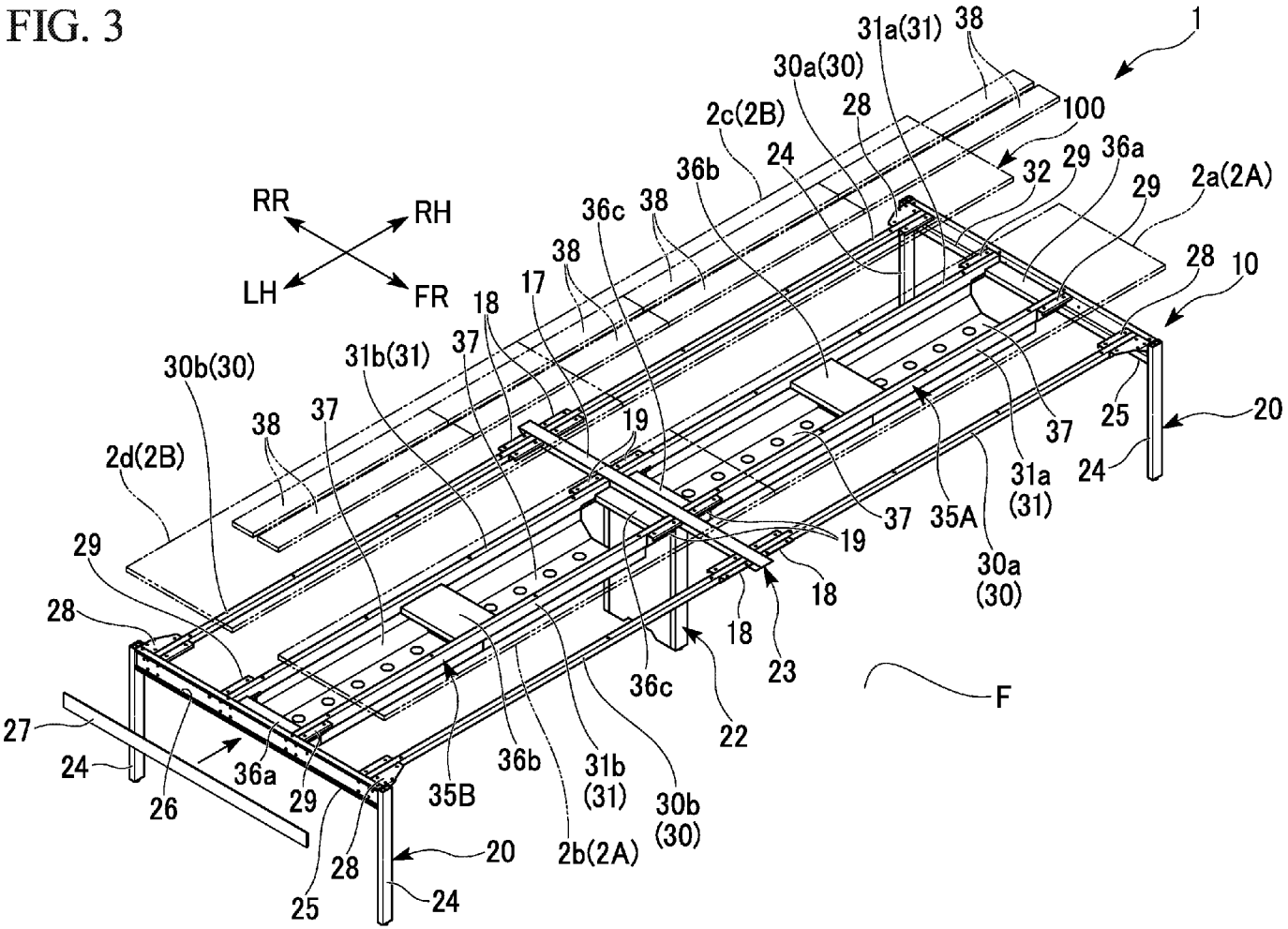
FIG. 3 is a perspective view mainly illustrating a top plate support of the desk apparatus to which the first top plate unit of the embodiment of this invention is attached.
Figure 4:
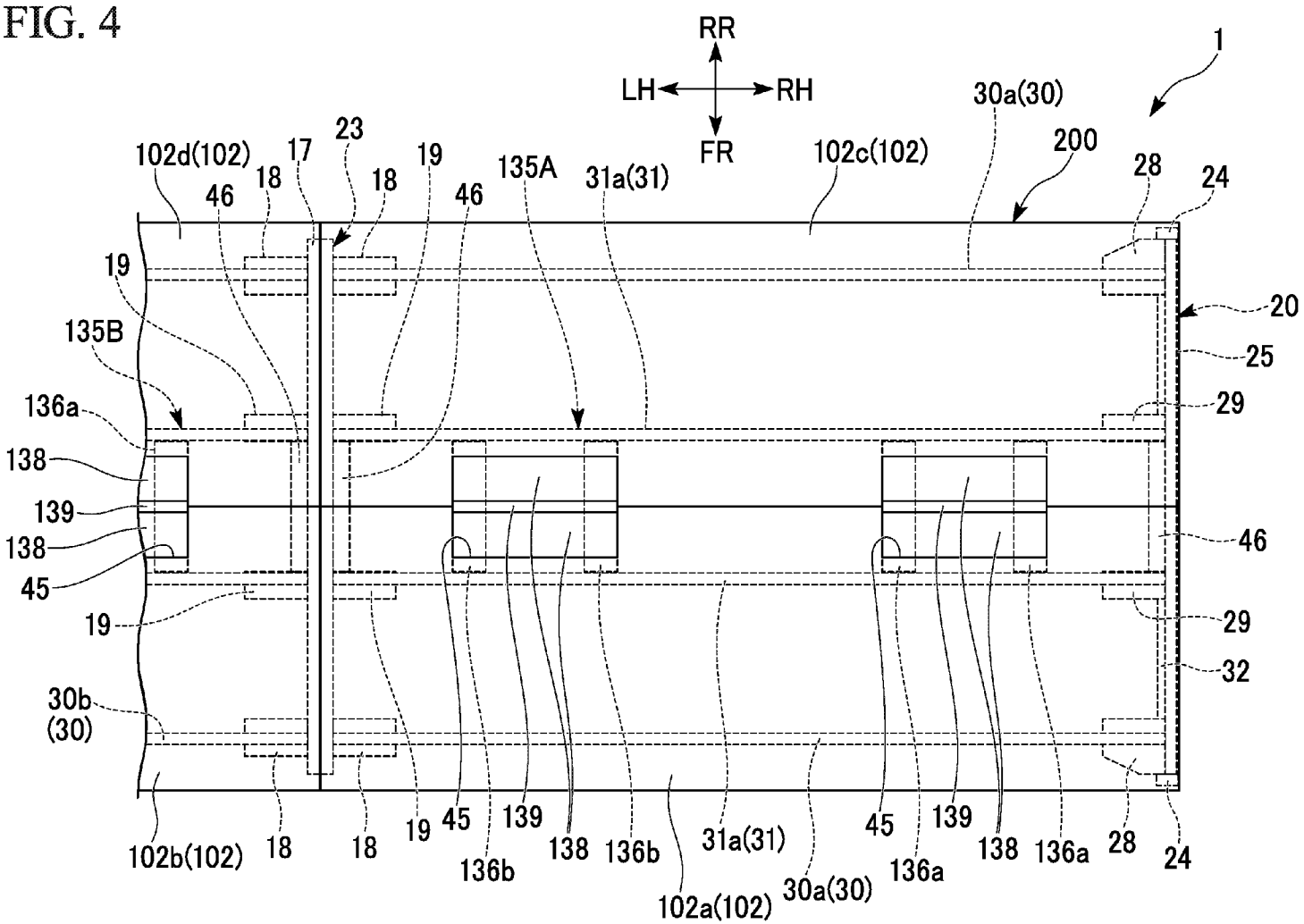
FIG. 4 is a plan view of the desk apparatus to which a second top plate unit of the embodiment of this invention is attached.
Figure 5:
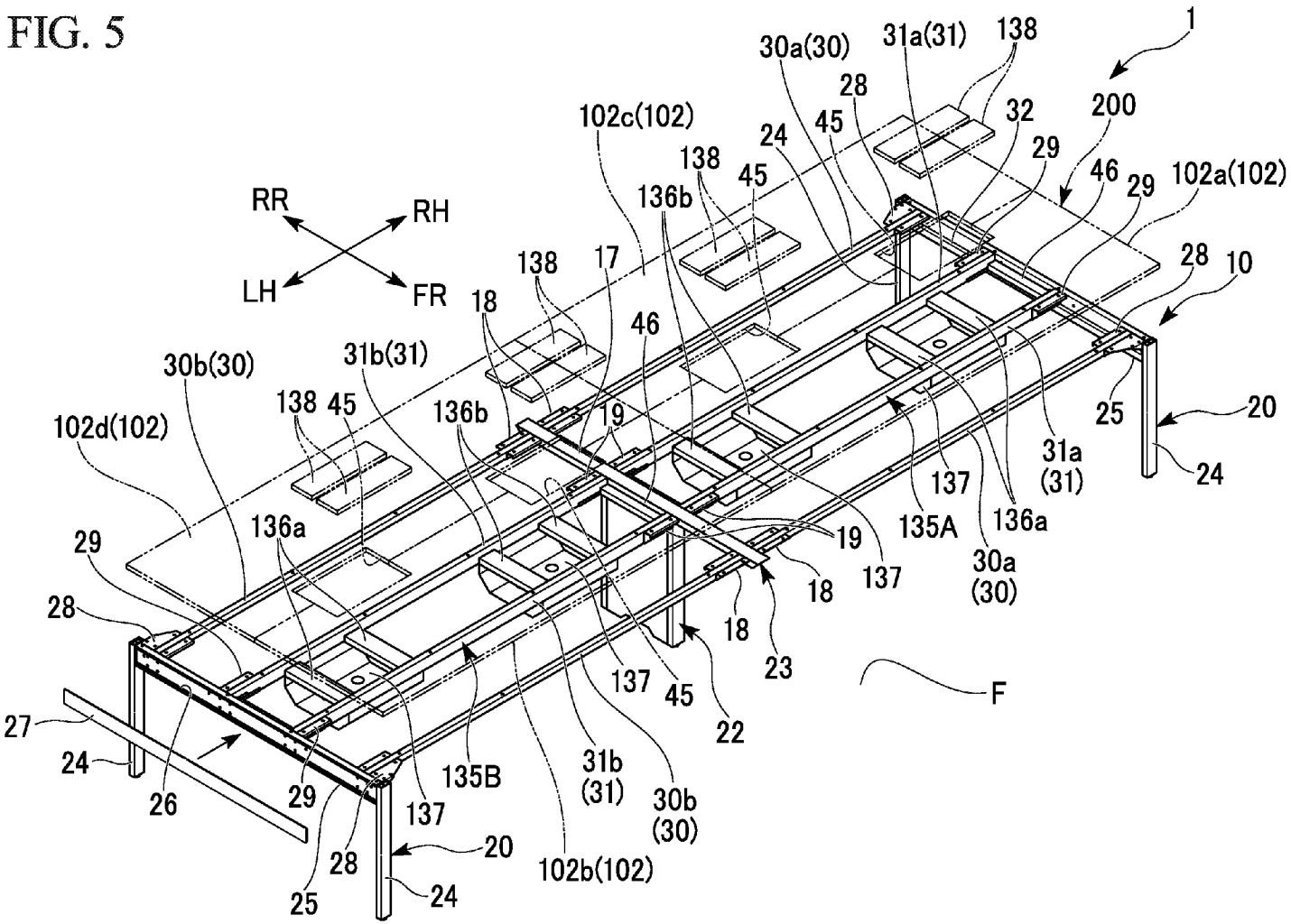
FIG. 5 is a perspective view mainly illustrating the top plate support of the desk apparatus to which the second top plate unit of the embodiment of this invention is attached.

FIGS. 1 to 3 illustrate a desk apparatus 1 when a first top plate unit 100 is adopted, and FIGS. 4 and 5 illustrate the desk apparatus 1 when a second top plate unit 200 having different aspects from the first top plate unit 100 is adopted.

FIG. 1 is a view illustrating an overall desk apparatus 1 installed on the floor surface F, and FIG. 2 is a view illustrating a top view of a half of the desk apparatus 1 in the width direction. Additionally, FIG. 3 is a view illustrating a top plate support 10 to which the first top plate unit 100 is attached. In addition, in FIG. 3, the first top plate unit 100 is illustrated by a phantom line.

As illustrated in FIGS. 1 to 3, the first top plate unit 100 has four top plate members 2*a*, 2*b*, 2*c*, and 2*d* that are rectangular in a plan view. The top plate members 2*a*, 2*b*, 2*c*, and 2*d* form a desk upper surface in which two top plate members 2*a* and 2*b* and two top plate members 2*c* and 2*d* are each continuous with a constant depth such that end surfaces thereof in the longitudinal direction are butted against each other. Pairs 2A and 2B (hereinafter referred to as "top plates 2A and 2B") of the two sets of top plate members that form the continuous desk upper surface are arranged to face each other with a separation space 3 interposed therebetween at the center in the depth direction. The top plates 2A and the 2B are arranged to face each other such that longer sides are parallel to each other, and the separation space 3 at the center in the depth direction is continuous along the width direction.

In addition, in this embodiment, the top plates 2A and 2B are respectively constituted of the two top plate members 2*a* and 2*b* and the two top plate members 2*c* and 2*d*. However, each of the top plates 2A and 2B may also be constituted of one continuous plate.

The top plate support 10, as illustrated in FIG. 3, includes a pair of leg members 20 that are arranged at both ends in the width direction, and outer connecting rods 30 and inner connecting rods 31 that connect upper portions of the pair of leg members 20. In this embodiment, an intermediate leg 22 is arranged between the pair of leg members 20, and a relay unit 23 is provided at an upper portion of the intermediate leg 22.

The outer connecting rods 30 are arranged in parallel at the ends of the top plate support 10 on both sides in the depth direction so as to run along the width direction, and support outer edge portions of the top plates 2A and 2B of the first top plate unit 100 in the depth direction from below. In the case of this embodiment, a pair of metallic angular tube members 30*a* and 30*b* are integrally connected via the relay unit 23, and thereby, the outer connecting rods 30 linearly extend along the width direction in their entirety.

The inner connecting rods 31 are arranged at a central region of the top plate support 10 in the depth direction so as to be parallel to the outer connecting rods 30, and respectively support inner edge portions of the top plates 2A and 2B of the first top plate unit 100 in the depth direction from below. The inner connecting rods 31 are arranged to be separated from each other at a predetermined distance in the depth direction. In the case of this embodiment, a pair of metallic angular tube members 31*a* and 31*b* are integrally connected via the relay unit 23, and, thereby, the inner connecting rods 31 linearly extend along the width direction in their entirety. In addition, the angular tube members 31*a* and 31*b* of the inner connecting rods 31 are practically components of two ladder-shaped connecting units 35A and 35B to be described in detail below.

In addition, the leg members 20 arranged on both sides in the width direction include two main leg member parts 24 that are installed on the floor surface F and extend in the vertical direction, and the crosspiece portion 25 that extends along the depth direction and connects upper portions of the main leg member parts 24. Each main leg member part 24 has an essential portion made of a metallic angular pipe, and end plates are welded and fixed to upper and lower ends of the angular pipe.

The crosspiece portion 25 is obtained by two press-formed metal plates being combined together, and an essential portion thereof is formed in a tubular shape. Both ends of the crosspiece portion 25 in a longitudinal direction are welded and fixed to upper side surfaces of the main leg member parts 24. In this way, the leg member 20 in which the crosspiece portion 25 is connected to the upper portions of the two main leg member parts 24 is formed in a gate shape (U-shape of which an opening side faces downward) in a side view as seen from the width direction.

An outer surface of the crosspiece portion 25 in the width direction is formed with a concave stepped portion 26 that extends along the depth direction. A cover member 27 is detachably attached to the concave stepped portion 26. An attachment seat (reference numeral is omitted) for attaching optional parts (not illustrated), such as an extension top plate and a cabinet, is provided within the concave stepped portion 26. The cover member 27 is detached from the leg member 20, when the optional parts are attached.

Additionally, a stepped portion 32, which is depressed in a concave shape, is continuously provided along the depth direction at an upper corner portion of the crosspiece portion 25 on the inner side in the width direction. Metallic supporting arms 28 for combining outer ends of the angular tube members 30*a* or 30*b* of the outer connecting rods 30 in the width direction, and metallic supporting arms 29 for combining outer ends of the angular tube members 31*a* or 31*b* of the inner connecting rods 31 in the width direction are welded and fixed to the stepped portion 32.

In the intermediate leg 22, a metal plate is joined to a frame and is formed in the shape of a panel. The relay unit 23 is integrally attached to an upper end of the intermediate leg 22. In the relay unit 23, metallic supporting arms 18 for combining inner ends of the angular tube members 30*a* or 30*b* of the outer connecting rods 30 in the width direction, and metallic supporting arms 19 for combining inner ends of the angular tube members 31*a* or 31*b* of the inner connecting rods 31 in the width direction are welded and fixed to side surfaces on both sides, in the width direction, of an angular tubular stay 17 extending in the depth direction.

The angular tube member 30*a* of each of the outer connecting rods 30 is laid over the supporting arm 28 of one leg member 20 and the supporting arm 18 of one side surface of the relay unit 23, and the angular tube member 30*b* of each of the remaining outer connecting rods is laid over the supporting arm 28 of the other leg member 20 and the supporting arm 18 of the other side surface of the relay unit 23. Similarly, the angular tube member 31*a* of each of the inner connecting rods 31 is laid over the supporting arm 29 of one leg member 20 and the supporting arm 19 of one side surface of the relay unit 23, and the angular tube member 31*b* of each of the remaining inner connecting rods is laid over the supporting arm 29 of the other leg member 20 and the supporting arm 19 of the other side surface of the relay unit 23. Particularly, the angular tube member 31*a* of each of the inner connecting rods 31 is detachably attached to the corresponding supporting arms 29 and 19 by bolt fastening or the like.

In addition, in the connecting unit 35A that has the angular tube members 31*a* as components, the angular tube members 31*a* that are arranged to face each other are connected together by three bridge members 36*a*, 36*b*, and 36*c* that extend in the depth direction. Similarly, in the connecting unit 35B that has the angular tube members 31*b* as components, the angular tube members 31*b* that are arranged to face each other are connected together by three bridge members 36*a*, 36*b*, and 36*c* that extend in the depth direction. The connecting units 35A and 35B have the same structure.

The bridge members 36*a*, 36*b*, and 36*c* of each of the connecting units 35A and 35B are arranged so as to be separated from each other at substantially equal intervals in the width direction. The bridge members 36*a* and 36*c* on both sides in the width direction are formed with the same width, and the central bridge member 36*b* is formed with a width approximately twice as large as that of the bridge members 36*a* and 36*c* on both sides. Rectangular space portions are respectively provided between the bridge members 36*a*, 36*b*, and 36*c* adjacent to each other, and wiring ducts 37 (wiring receiving members) having a concave cross-section are respectively arranged below these space portions. The wiring ducts 37 are fixed to lower surfaces of the angular tube members 31*a* or the angular tube members 31*b* of the inner connecting rods 31 by screw fastening or the like. The wiring ducts 37 are portions that allow wiring, such as electrical wiring, communication wiring, or the like, which is drawn thereinto from the outside of the desk apparatus 1, to pass therethrough and be held thereby. The wiring lines passing through the wiring ducts 37 are drawn out onto the top plates 2A and 2B through the space portions between the bridge members 36*a*, 36*b*, and 36*c* adjacent to each other and the separation space 3 at the center of the first top plate unit 100 in the depth direction.

Additionally, two wiring covers 38 are tiltably laid over the adjacent bridge members 36*a*, 36*b*, and 36*c* of the connecting units 35A and 35B. The wiring covers 38 are openably and closably arranged within the separation space 3 at the center of the first top plate unit 100 in the depth direction in a state where the first top plate unit 100 is attached to the top plate support 10, and can be appropriately opened in accordance with the layout of the wiring.

In addition, in this embodiment, a hiding member 39 (omitted in FIG. 3) that fills a gap between the front and rear wiring covers 38 in the depth direction is further laid over between the bridge members 36*a*, 36*b*, and 36*c* adjacent to each other. However, it is also possible to install a partition member (not illustrated), such as a desk top panel or a modesty panel, which partitions off the top plates 2A and 2B that face each other, instead of the hiding member 39, in a region where the hiding member 39 is installed.

The connecting units 35A and 35B are detachably fastened and fixed to the leg members 20 and the relay unit 23 only at the portions of the inner connecting rods 31 (angular tube members 31*a* and 31*b*). Therefore, the connecting units 35A and 35B are attachable to and detachable from the remaining members of the top plate support 10 excluding the connecting units 35A and 35B themselves.

Additionally, in the top plates 2A and 2B of the first top plate unit 100, the separation space 3 is provided at the centers of both the top plates in the depth direction is placed at an upper portion of the top plate support 10, and is detachably fastened and fixed to the supporting arms 28, 29, 18, 19, and the like that are members on the top plate support 10 side in that state. In the case of this embodiment, bolt insertion holes (reference numerals are omitted) are made in upper wall portions of the supporting arms 28, 29, 18, and 19, and nuts (not illustrated) are buried in corresponding places of the back surface of the top plates 2A and 2B, and fastening bolts (not illustrated) are inserted into and engaged with the bolt insertion holes and the nuts.

Since the first top plate unit 100 is provided with the separation space 3 that extends along the width direction between the pair of top plates 2A and 2B and lead-out portions or partition members for wiring are arranged in the separation space 3, the first top plate unit is suitable when a plurality of persons sit down facing the top plate 2A and 2B and individually perform desk work.

FIG. 4 is a view illustrating a top view of a half of the desk apparatus 1 in the width direction when a second top plate unit 200 is adopted, and FIG. 5 is a view illustrating the top plate support 10 to which the second top plate unit 200 is attached. In addition, in FIG. 5, the second top plate unit 200 is illustrated by a phantom line.

As illustrated in FIGS. 4 to 5, the second top plate unit 200 has four top plate members 102*a*, 102*b*, 102*c*, and 102*d* that are rectangular in a plan view. The top plate members 102*a*, 102*b*, 102*c*, and 102*d* form a continuous rectangular desk upper surface in which end surfaces of the top plate members adjacent to each other are butted against each other when being attached on the top plate support 10. Hereinafter, the top plate members 102*a*, 102*b*, 102*c*, and 102*d* are collectively referred to as a top plate 102. Four rectangular openings 45 are formed along the width direction at the center of the top plate 102 in the depth direction. These four openings 45 are separated and arranged at substantially equal intervals on the top plate 102. The openings 45 are used as wiring lead-out portions in the second top plate unit 200.

In this embodiment, the top plate 102 is constituted of the four top plate members 102*a*, 102*b*, 102*c*, and 102*d*. However, the top plate 102 may be constituted of two top plate members or may be constituted of one plate.

The second top plate unit 200 can ensure a continuous wide work space so as to surround the openings 45, in a central region in the depth direction unlike the first top plate unit 100. Therefore, this second top plate unit 200 is suitable for a case where a lot of people perform conversations or referencing of data face to face at the desk in meetings or the like, or a case where a lot of people perform cooperative work at the desk.

In addition, the top plate support 10 that supports the second top plate unit 200 is different from the aforementioned top plate support 10 that supports the first top plate unit 100, only in connecting units 135A and 135B. The connecting units 135A and 135B are detachably fastened and fixed to the supporting arms 29 of the leg members 20 and the supporting arms 19 of the relay unit 23, similar to the connecting units 35A and 35B of the top plate support 10 that supports the first top plate unit 100.

Although the connecting unit 135A and the connecting unit 135B have basically the same structure, one connecting unit 135A uses the pair of angular tube members 31*a* along the width direction as constituent elements, and the other connecting unit 135B uses the pair of angular tube members 31*b* along the width direction as constituent elements. The angular tube members 31*a* of the one connecting unit 135A and the angular tube members 31*b* of the other connecting unit 135B are connected to each other via the relay unit 23, and constitute a pair of continuous inner connecting rods 31 by the relay unit 23.

Additionally, the angular tube members 31*a* that constitute the connecting unit 135A are connected together by two pairs of bridge members 136*a* and bridge members 136*b* extending along the depth direction. The angular tube members 31*b* that constitute the connecting unit 135B, similarly, are connected together by two pairs of bridge members 136*a* and bridge members 136*b* extending along the depth direction. The pair of bridge members 136*a* and the pair of bridge members 136*b* are provided corresponding to the positions of the openings 45 of the second top plate unit 200.

In addition, reference numeral 46 in the drawings designates auxiliary connecting members that connect the ends on both sides of the angular tube members 31*a* and the angular tube members 31*b* of the connecting units 135A and 135B.

Additionally, rectangular space portions are respectively provided between the bridge members 136*a* and between the bridge members 136*b* in the connecting units 135A and 135B, and the wiring ducts 137 (wiring receiving members)

are respectively arranged below these space portions. The wiring ducts 137 are fixed to the lower surfaces of the angular tube members 31*a* or the angular tube members 31*b* by screw fastening or the like. Wiring lines are allowed to pass through the wiring ducts 137 from the outside, and the wiring lines are lead out to the desk upper surface of the top plate unit 200 through the openings 45 of the second top plate unit 200.

Moreover, two wiring covers 138 and 138 that each block the openings 45 of the second top plate unit 200 are respectively and tiltably laid over the bridge members 136*a* and the bridge members 136*b* that make pairs. The wiring covers 138 are appropriately opened in accordance with a wiring layout. In addition, reference numeral 139 in the drawings is a hiding member that fills a gap between the wiring covers 138.

In the second top plate unit 200, the top plate members 102*a*, 102*b*, 102*c*, and 102*d* that constitute the top plate 102 are placed on an upper portion of the top plate support 10. The top plate members 102*a*, 102*b*, 102*c*, and 102*d* are detachably fixed to the supporting arms 28, 29, 18, 19, and the like that are members on the top plate support 10 side with fastening bolts.

Additionally, the connecting units 135A and 135B are attachable to and detachable from the remaining members of the top plate support 10 excluding the connecting units 135A and 135B themselves.

As described above, in the desk apparatus 1 related to this embodiment, the first top plate unit 100 and the second top plate unit 200 are attachable to and detachable from the top plate support 10, and the connecting units 35A and 35B, and 135A and 135B are also attachable to and detachable from the remaining members of the top plate support 10 excluding the connecting units 35A, 35B, 135A, and 135B. Therefore, for example, when the first top plate unit 100 is adopted in a workplace environment in which a plurality of persons individually perform desk work, and when the desk apparatus is intended to be changed to one suitable for meetings or the like in accordance with a user's reorganization or change of the way of working, change to the aspect of the desk apparatus in accordance with a user's demands can be made by replacing the first top plate unit 100 and the connecting units 35A and 35B with the top plate unit 200 and the second connecting units 135A and 135B.

Since the desk apparatus 1 can be changed into the aspect of the desk apparatus in accordance with the user's demands simply by keeping the replacement of members to a necessary minimum with the principal parts of the top plate support 10 shared, a purchaser's cost burden can be reduced.

Additionally, in the desk apparatus 1 related to this embodiment, optional parts, such as the wiring covers 38 and 138 and the partition members can be laid in the adjacent bridge members 36*a*, 36*b*, and 36*c*, the bridge members 136*a* and the bridge members 136*b*, of the connecting units 35A, 35B, 135A, and 135B. Therefore, the usability as the desk apparatus can be further diversified.

In addition, in the above embodiment, the entirety of connecting units is replaced when the existing top plate unit is replaced with a top plate unit having different aspects. However, a plurality of bridge members connected to a pair of inner connecting rods may be made detachable, and the bridge members may be replaced in accordance with the aspects of a top plate unit to be replaced, or only the connecting positions of the bridge members to the pair of inner connecting rods may be changed.

In this case, when a top plate unit is replaced, the pair of inner connecting rods of a connecting unit can also be shared as they are. Therefore, it is possible to reduce the number of replacement members to further reduce product costs.

In addition, the invention is not limited to the above embodiment, and various design changes can be made without departing from the scope of the invention. For example, in the above embodiment, the intermediate leg is arranged between the pair of leg members and the angular tube members of the outer connecting rods or the inner connecting rods are connected together by the relay unit provided at the intermediate leg. However, the intermediate leg is not necessarily required, and the outer connecting rods or the inner connecting rods can be made integrally continuous with each other.

INDUSTRIAL APPLICABILITY

According to the invention, it is possible to provide a desk apparatus that can change the aspects thereof in accordance with a user's demands by keeping the replacement of members to a necessary minimum.

REFERENCE SIGNS LIST

1: DESK APPARATUS
2A, 2B, 102: TOP PLATE
3: SEPARATION SPACE
10: TOP PLATE SUPPORT
20: LEG MEMBER
24: MAIN LEG MEMBER PART
25: CROSSPIECE PORTION
30: OUTER CONNECTING ROD
31: INNER CONNECTING ROD
35A, 35B, 135A, 135B: CONNECTING UNIT
36*a*, 36 *b*, 36*c*, 136*a*, 136*b*: BRIDGE MEMBER
45: OPENING
100: FIRST TOP PLATE UNIT (TOP PLATE UNIT)
200: SECOND TOP PLATE UNIT (TOP PLATE UNIT)

The invention claimed is:

1. A desk apparatus comprising:

a pair of leg members each having two main leg member parts that are installed on a floor surface and extend in a vertical direction and that are connected to each other by means of a crosspiece portion at upper portions of the main leg member parts;

connecting rods that extend along a width direction orthogonal to a depth direction that is a direction in which the crosspiece portion extends and that connect upper portions of the pair of leg members; and a top plate unit that is supported by the pair of leg members and includes a top plate, wherein the connecting rods include a pair of inner connecting rods arranged to be separated from each other in a central region of the top plate unit in the depth direction, wherein the pair of inner connecting rods are connected together by bridge members along the depth direction to constitute a connecting unit, and wherein the top plate unit is attachable to and detachable from a top plate support including the pair of leg members, the connecting unit, and remaining connecting rods excluding the inner connecting rods, and part or all of the connecting unit is attachable to and detachable from remaining members of the top plate support.

2. The desk apparatus according to claim 1, wherein the connecting units which have different bridge members from each other are replaceable with each other between when the top plate unit is a top plate unit which includes the single top plate in which an opening is provided at the center thereof in the depth direction, and when the top plate unit is a top plate unit which includes the double top plates arranged to each other in a manner such that a separation space that is continuous along the width direction is provided at the center in the depth direction.

3. The desk apparatus according to claim 2, wherein a wiring cover is configured to be laid over the adjacent bridge members of the connecting unit.

4. The desk apparatus according to claim 3, wherein when the top plate unit is a top plate unit which includes the single top plate in which an opening is provided at the center thereof in the depth direction, the wiring cover is configured to open and close the openings, or when the top plate unit is a top plate unit which includes the double top plates arranged to each other in a manner such that a separation space that is continuous along the width direction is provided at the center in the depth direction, the wiring cover is configured to open and close the separation space.

5. The desk apparatus according to claim 1, wherein bridge members of the connecting unit are attachable to and detachable from the pair of inner connecting rods, and wherein the connecting positions of the bridge members to the pair of inner connecting rods are changeable between when the top plate unit is a top plate unit which includes the single top plate in which an opening is provided at the center thereof in the depth direction, and when the top plate unit is a top plate unit which includes the double top plates arranged to each other in a manner such that a separation space that is continuous along the width direction is provided at the center in the depth direction.

6. The desk apparatus according to claim 5, wherein a wiring cover is configured to be laid over the adjacent bridge members of the connecting unit.

7. The desk apparatus according to claim 6, wherein when the top plate unit is a top plate unit which includes the single top plate in which an opening is provided at the center thereof in the depth direction, the wiring cover is configured to open and close the openings, or when the top plate unit is a top plate unit which includes the double top plates arranged to each other in a manner such that a separation space that is continuous along the width direction is provided at the center in the depth direction, the wiring cover is configured to open and close the separation space.

8. The desk apparatus according to claim 1, wherein a wiring cover is configured to be laid over the adjacent bridge members of the connecting unit.

9. The desk apparatus according to claim 8, wherein when the top plate unit is a top plate unit which includes the single top plate in which an opening is provided at the center thereof in the depth direction, the wiring cover is configured to open and close the openings, or when the top plate unit is a top plate unit which includes the double top plates arranged to each other in a manner such that a separation space that is continuous along the width direction is provided at the center in the depth direction, the wiring cover is configured to open and close the separation space.

* * * * *